US010531200B2

(12) United States Patent
Voishvillo

(10) Patent No.: US 10,531,200 B2
(45) Date of Patent: Jan. 7, 2020

(54) DUAL ASYMMETRIC COMPRESSION DRIVER

(71) Applicant: HARMAN INTERNATIONAL INDUSTRIES, INCORPORATED, Stamford, CT (US)

(72) Inventor: Alexander Voishvillo, Simi Valley, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/760,962

(22) PCT Filed: Oct. 21, 2016

(86) PCT No.: PCT/US2016/058138
§ 371 (c)(1),
(2) Date: Mar. 16, 2018

(87) PCT Pub. No.: WO2017/070481
PCT Pub. Date: Apr. 27, 2017

(65) Prior Publication Data

US 2018/0255399 A1 Sep. 6, 2018

Related U.S. Application Data

(60) Provisional application No. 62/245,712, filed on Oct. 23, 2015.

(51) Int. Cl.
*H04R 7/22* (2006.01)
*H04R 1/28* (2006.01)
(Continued)

(52) U.S. Cl.
CPC ..... *H04R 7/22* (2013.01); *H04R 1/24* (2013.01); *H04R 1/28* (2013.01); *H04R 7/04* (2013.01);
(Continued)

(58) Field of Classification Search
CPC ..... H04R 9/025; H04R 1/1075; H04R 1/345; H04R 1/1016; H04R 1/2826;
(Continued)

(56) References Cited

U.S. PATENT DOCUMENTS 5,526,456 A 6/1996 Heinz
8,280,091 B2 10/2012 Voishvillo
(Continued)

OTHER PUBLICATIONS

Lampton, "Transmission Matrices in Electroacoustics", Acustica, vol. 39, No. 4, 1978, pp. 239-251.
(Continued)

*Primary Examiner* — Curtis A Kuntz
*Assistant Examiner* — Julie X Dang
(74) *Attorney, Agent, or Firm* — Brooks Kushman P.C.

(57) ABSTRACT

In at least one embodiment, a dual asymmetric compression driver is provided. The dual asymmetric compression driver includes a first driver assembly and a second driver assembly. The first driver assembly is positioned about a central axis and includes a first annular diaphragm having a first planar section extending at a first clamping distance. The second driver assembly is positioned about the central axis and includes a second annular diaphragm having a second planar section extending at a second clamping distance. The first clamping distance is different from the second clamping distance causing the first asymmetric driver to provide a first audio output in a first frequency range and the second driver assembly to provide a second audio output in a second frequency range.

19 Claims, 8 Drawing Sheets

(51) Int. Cl.
*H04R 7/04* (2006.01)
*H04R 1/24* (2006.01)
*H04R 1/34* (2006.01)

(52) U.S. Cl.
CPC ..... *H04R 1/345* (2013.01); *H04R 2201/34* (2013.01); *H04R 2400/13* (2013.01)

(58) Field of Classification Search
CPC ..... H04R 2420/07; H04R 5/033; H04R 1/02; H04R 1/2857; G01F 22/00; G01F 11/086; G05B 23/02; G05B 19/4099; G05B 2219/35134; G05B 2219/49007; G05B 15/02; G05B 2219/2642; G05D 7/0647; H04L 63/102; H04L 67/12; H04L 67/125; H04L 67/38; H04L 9/0662; H04L 9/34
USPC ..... 381/389, 399, 400
See application file for complete search history.

(56) References Cited

U.S. PATENT DOCUMENTS 9,008,343 B2 4/2015 Dimitrov
2002/0057819 A1 5/2002 Czerwinski et al.
2011/0085692 A1* 4/2011 Voishvillo ..... H04R 1/30 381/343

OTHER PUBLICATIONS

Dodd et al., "New Methodology for the Acoustic Design of Compression Driver Phase Plugs with Concentric Annular Channels", J. Audio Eng. Soc., vol. 57, No. 10, Oct. 2009, pp. 771-787.
Smith, "An Investigation of the Air Chamber of Horn Type Loudspeakers", J. Acoust. Soc. Am., vol. 25, No. 2, Mar. 1953, pp. 305-312.
Voishvillo, "Identification of compression driver parameters based on a concept of the diaphragm's frequency-dependent area", 137th AES Convention, Los Angeles, CA, Oct. 9-12, 2014, 10 pages.
Voishvillo, "Simulation of Horn Drive Response by Combination of Matrix Analysis and FEA", 129th AES Convention, San Francisco, CA, Nov. 4-7, 2010, 10 pages.
Mapes-Riordan, "Horn Modeling with Conical and Cylindrical Transmission-Line Elements", J. Audio Eng. Soc., vol. 41, No. 6, Jun. 1993, pp. 471-484.

* cited by examiner

DUAL ASYMMETRIC COMPRESSION DRIVER

CROSS-REFERENCE TO RELATED APPLICATIONS

This application is the U.S. national phase of PCT Application No. PCT/US2016/058138 filed on Oct. 21, 2016, which claims the benefit of U.S. provisional application Ser. No. 62/245,712 filed Oct. 23, 2015, the disclosures of which are hereby incorporated in their entirety by reference herein.

TECHNICAL FIELD

Aspects disclosed herein generally relate to a dual asymmetric compression driver.

BACKGROUND

U.S. Pat. No. 8,280,091 to Voishvillo discloses, among other things, a phasing plug that includes a base portion having an input side, an output side, a plurality of entrances on the input side, a plurality of exits on the output side arranged about a central axis, and a plurality of channels fluidly interconnecting the entrances with the respective exits. Each corresponding entrance, channel and exit establish an acoustical path from the input side to the output side that is non-radial relative to the central axis. Two phasing plugs may be provided in a dual compression driver.

SUMMARY

In at least one embodiment, a dual asymmetric compression driver is provided. The dual asymmetric compression driver includes a first driver assembly and a first driver assembly. The first driver assembly is positioned about a central axis and includes a first annular diaphragm having a first planar section extending at a first clamping distance. The second asymmetric driver assembly is positioned about the central axis and includes a second annular diaphragm having a second planar section extending at a second clamping distance. The first clamping distance is different from the second clamping distance causing the first asymmetric driver to provide a first audio output in a first frequency range and the second asymmetric driver to provide a second audio output in a second frequency range.

In at least another embodiment, a dual asymmetric compression driver is provided. The dual asymmetric compression driver includes a first driver assembly and a second asymmetric driver assembly. The first driver assembly is aligned on a central axis and includes a first annular diaphragm having a first planar section extending at a first clamping distance. The first driver assembly provides a first audio output in a first frequency range. The second asymmetric driver assembly is aligned on the central axis and includes a second annular diaphragm having a second planar section extending at a second clamping distance. The second asymmetric driver assembly provides a second audio output in a second frequency range and the first clamping distance is different from the second clamping distance.

In at least another embodiment, a dual asymmetric compression driver is provided. The dual asymmetric compression driver includes a front driver assembly and a rear driver assembly. The front driver assembly is aligned on a central axis and includes a front annular diaphragm having a front inner planar section that extends at a front inner clamping distance and a front outer planar section that extends at a front outer clamping distance. The rear driver assembly is aligned on the central axis and includes a rear annular diaphragm having a rear inner planar section that extends at a rear inner clamping distance and a rear outer planar section that extends at a rear outer clamping distance. The front inner clamping distance and the front outer clamping distance is larger than the rear inner clamping distance and the rear outer clamping distance, respectively.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
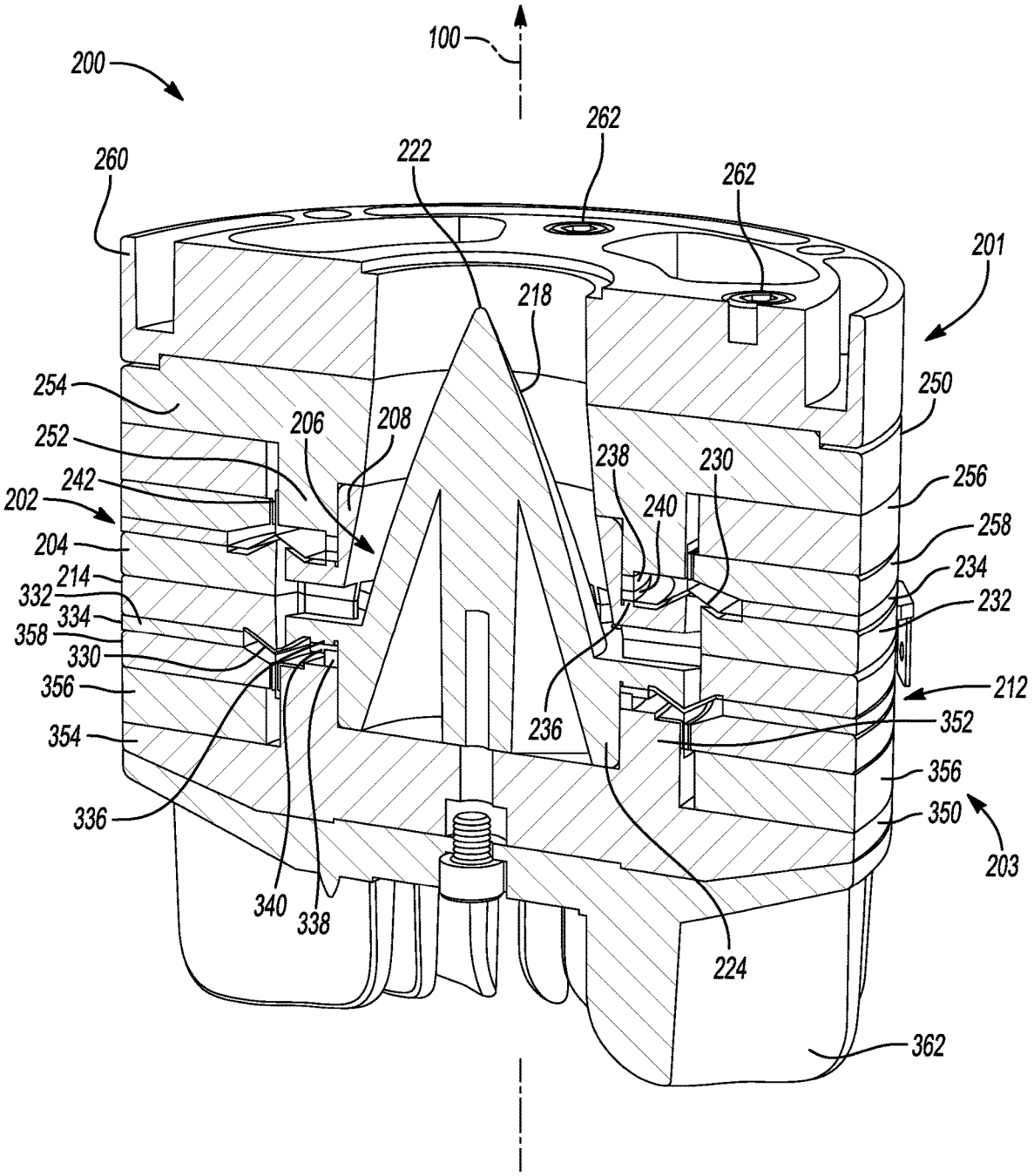
FIG. 1 is a cross-sectional view of a dual asymmetric compression driver in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A dual compression driver as set forth herein generally includes two motors and acoustically similar phasing plugs and diaphragms that are mechanically "tuned" to different frequency ranges. A summation of acoustical signals on common acoustical load provides extended frequency range compared to a dual compression driver that includes identical diaphragms. Theoretically maximum overall SPL sensitivity may be achieved by an in-phase radiation of the diaphragms. These aspects and others will be discussed in more detail below.

Conventional compression drivers may have several factors that limit their high-frequency range. Such factors may involve the diaphragm assembly's moving mass, compliance of air in a compression chamber, air resonances in the compression chamber, and a voice coil's inductance. One of the methods to increase the high frequency output level is to use full-metal (typically titanium) dome based diaphragm and surround exhibit high-frequency mechanical resonances (breakups). However, such resonances may cause an irregularity of the high-frequency response and the resonances are accompanied by a generation of strong nonlinear distortion including subharmonic distortion products that deteriorate sound quality.

The decrease of a compression chamber's air compliance helps to extend the level of a high-frequency signal. For example, the high level frequency may be reached by decreasing a clearance between a diaphragm and a phasing plug. However, the smaller height of the compression chamber may cause buzzing, increase nonlinear distortion due to nonlinear compression of air, limit maximum sound pressure level, or even cause collision of the diaphragm with the phasing plug. Reduction of the voice coil inductance may be provided through the use of conducting rings that are positioned in a voice coil gap which are typically made of copper. However, this aspect may make a voice coil gap wider magnetically and decrease the gap's magnetic induction and correspondingly, the motor force. The decrease of the moving mass in a conventional compression driver may be provided only by using a lighter moving assembly having a smaller diameter and lighter voice coil and diaphragm. A small voice coil is typically associated with a lower power handling capability and a higher thermal compression. High-frequency air resonances in the compression chamber may occur at frequencies where a radial dimension of the chamber is comparable or larger than a wavelength of the radiated signal. Existing methodologies of suppressing air resonances by positioning circular openings in the phasing plug at particular locations are based on an assumption of an infinitely rigid diaphragm. These aspects are set forth in "An Investigation of the Air Chamber of Horn Type Loudspeakers" to Bob Smith, *J. Acoust. Soc. Am.*, vol. 25, No. 2, March, 1953, pp. 305-312 and in New Methodology for the Acoustic Design of Compression Driver Phase Plugs with Concentric Annular Channels" to Mark Dodd and Jack Oclee-Brown, *J. Audio Eng. Soc.*, Vol. 57, No. 10, 2009 October, pp. 771-787.

However, in reality the assumption of an infinitely rigid diaphragm may not be valid when the diaphragm goes into partial vibrations at high frequencies, and in this case, the particular radial location of the phasing plug's circular slots may not contribute to suppression of the high-frequency resonances. These issues have been resolved to a significant degree in view of the dual compression drivers that are based on flexural annular diaphragms as set forth in U.S. Pat. No. 8,280,091 ("the '091 patent") to Voishvillo which is incorporated by reference in its entirety. The '091 patent discloses, among other things, the concept of a "symmetric" dual diaphragm driver having two compression drivers that are merged into a single compact transducer with a single acoustical output. Each "half" is equipped with an identical annular, light, flexural polymer diaphragm. Each diaphragm is loaded by its own phasing plug, with a "meandering" distribution of acoustical exits to smear the air resonances in the compression chamber, and these two acoustically similar phasing plugs are connected to a single common acoustical load—horn or waveguide.

The dual asymmetric compression driver as set forth herein may be based on identical motors and on different phasing plugs whereby the annular diaphragms are mechanically "tuned" to different frequency ranges. Such an arrangement may optimize the performance of each diaphragm assembly for a dedicated frequency range. Both phasing plugs may face each other and may have centrally oriented slots that are acoustically connected to a common acoustical load. Two general types of asymmetric drivers may be considered. For example, a first type of asymmetric driver may present a "classical" two-way system with a comparatively narrow frequency range of overlapping, and the other type (or second type) of asymmetric driver may include the diaphragms that have a comparatively wide overlapping frequency range whereby the lower frequency range section is not limited at its high frequency range. This aspect contributes to an output of the other section. This type of configuration provides higher overall SPL output and maximum sensitivity is achieved when both diaphragms radiate in-phase in a mutual frequency range.

Figure 2:
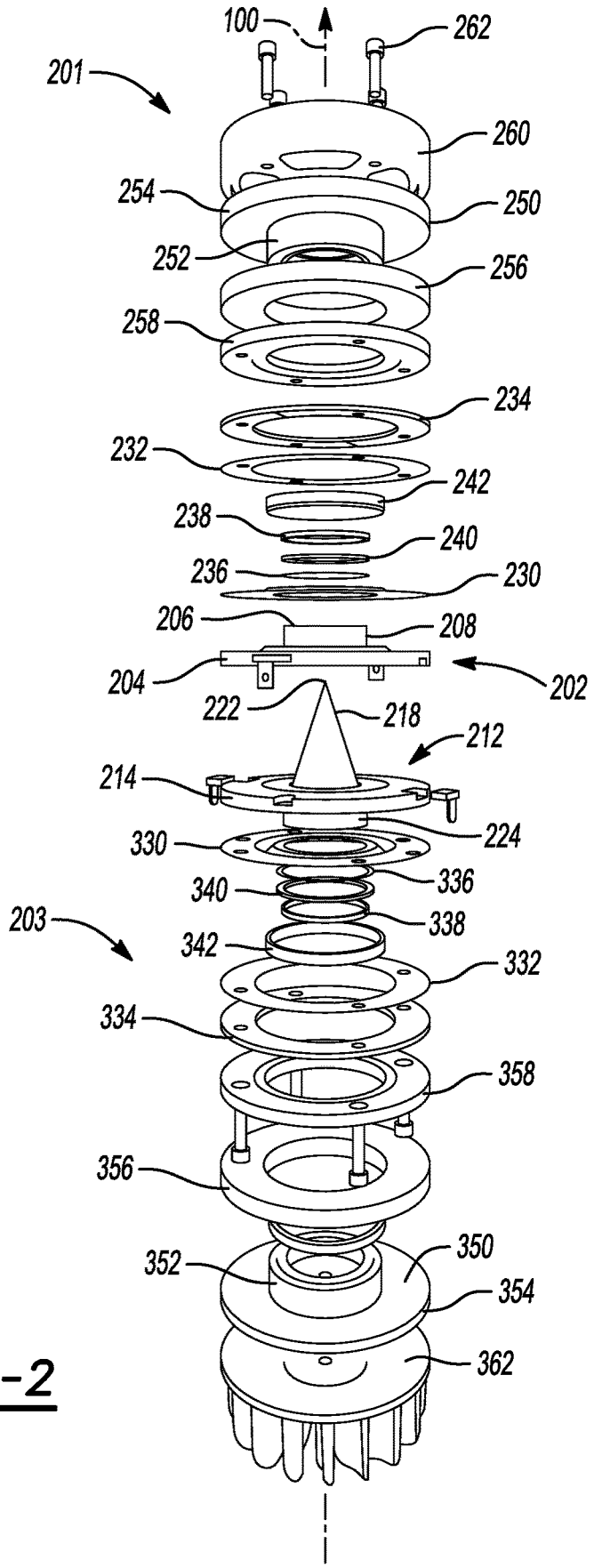
FIG. 2 is an exploded view of the dual asymmetric compression driver in accordance to one embodiment.

As shown in FIGS. 1 and 2, a dual asymmetric compression driver 200 including a front driver assembly 201 (or mid-frequency driver) and a rear driver assembly 203 (or high frequency driver) that may be utilized in a loudspeaker (not shown) is provided. Various components of the driver 200 may be disposed generally about a central axis 100. For descriptive purposes, some components may be referred to as "front" components while other components may be referred to as "rear" components. It will be understood, however, that the terms "front" and "rear" in this context are not intended to limit the dual asymmetric compression driver 200 to any particular orientation in space.

The front driver assembly 201 includes a front phasing plug 202. The front phasing plug 202 includes a front base portion or body 204, which may be generally disk-shaped and lie in a plane orthogonal to the central axis 100, and may be generally centered about the central axis 100. A central bore 206 coaxial with the central axis 100 is formed through a thickness (axial direction) of the front base portion 204 to open at both an input side (facing upward from the perspective of FIG. 1) and an output side (facing downward) of the front base portion 204. The front phasing plug 202 may also include a hollow hub portion or conduit 208 axially extending from an input side. The conduit 208 may be provided as an annular wall coaxial with the central axis 100. An inside diameter of the conduit 208 may be substantially the same as a diameter of the central bore 206. The conduit 208 may be considered as an extension of the central bore 206.

The rear driver assembly 203 includes a rear phasing plug 212. The rear phasing plug 212 includes a rear base portion (or rear base body) 214, which likewise may be generally disk-shaped and lie in a plane orthogonal to the central axis 100, and may be generally centered about the central axis 100. The rear phasing plug 212 may also include a hub portion 218 axially extending from an output side of the rear base portion 214. In the present example, the output side of the rear base portion 214 faces the output side of the front base portion 204. The hub portion 218 may be bullet-shaped and accordingly may be referred to as a bullet. That is, the diameter (coaxial with the central axis 100) of the outside surface of the hub portion 218 typically tapers in the axial direction to an apex or tip 222 located on the central axis 100. The tip 222 may be relatively sharp or may be domed. A diameter of the outside surface of the hub portion 218 at the rear base portion 214 is less than the inside diameter of the central bore 206. When assembled, the hub portion 218 extends through the central bore 206 and, if provided, through the conduit 208 to an axial elevation above the front phasing plug 202. The rear phasing plug 212 may also include an annular mounting structure 224 axially extending from an input side of the rear base portion 214, which may facilitate mounting the rear phasing plug 212 to underlying components as will be described further below.

Figure 3:
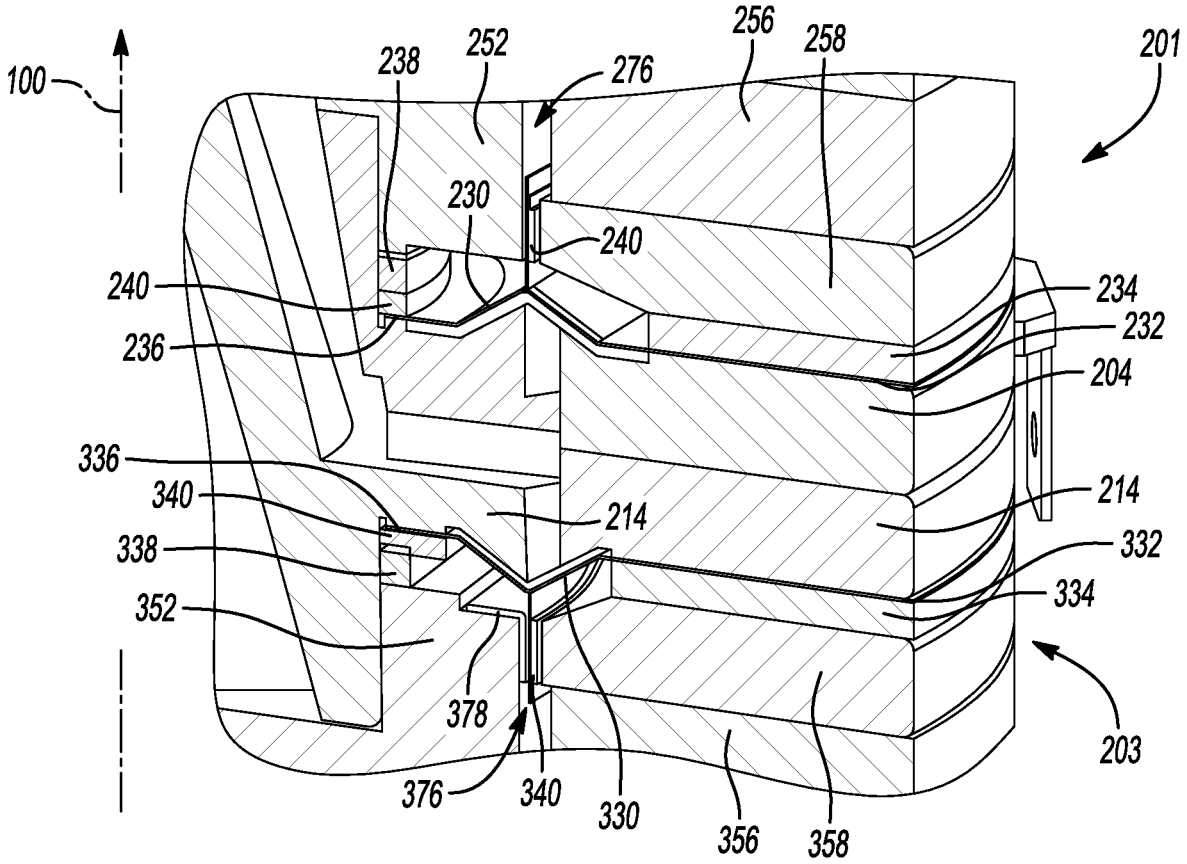
FIG. 3 is a detailed cross-sectional view of a front annular diaphragm and a rear annular diaphragm as positioned on the dual asymmetric compression driver in accordance to one embodiment.

As further illustrated in FIGS. 1-3, a front annular diaphragm 230 may be mounted at an input side of the front base portion 204 such that the front annular diaphragm 230 is concentric to the central bore 206. The front annular diaphragm 230 may be constructed of any flexible material suitable for loudspeakers. An outer portion of the front annular diaphragm 230 may be mounted axially between the front base portion 204 and a front outer annular glue ring 232. A front outer annular aluminum ring 234 may be mounted on the front outer annular glue ring 232 to apply a force onto the front outer annular glue ring 232 and onto the outer portion of the front annular diaphragm 230.

An inner portion of the front annular diaphragm 230 may be mounted axially between the front base portion 204 and a front inner annular glue ring 236. In other words, the front inner annular glue ring 236 is positioned on the inner portion of the front annular diaphragm 230. A front inner aluminum ring 240 is concentrically attached to a top side of the front inner annular glue ring 236. A front inner annular rubber ring 238 may be concentrically mounted on the front inner aluminum ring 240 at the inner portion of the front annular diaphragm 230.

A front voice coil 242 is attached to a moveable portion of the front annular diaphragm 230. The front voice coil 242 may be attached via glue or other suitable manner to the front annular diaphragm 230. A back plate (or pole piece) 250 including an inner extended portion 252 and an exterior outer portion 254 lies in a plane orthogonal to the central axis 100 and is received by the conduit 208 of the front phasing plug 202. As shown in FIG. 1, the inner extended portion 252 surrounds at least a portion of the conduit 208 and is positioned over the inner portion of the front annular diaphragm 230. A front magnet 256 is positioned underneath the exterior outer portion 254 of the back plate 250 and surrounds at least a portion of the inner extended portion 252. A top plate 258 is positioned between the front magnet 256 and the front outer annular aluminum ring 234. A front back plate (or pole piece) 250 lies in a plane orthogonal to the central axis 100 and surrounds at least a portion of the hub portion 218. A front adapter 260 is positioned on the back plate 250 for receiving fastening mechanisms 262.

A rear annular diaphragm 330 is generally mounted at an input side of the rear base portion 214 of the rear phasing plug 212. A rear outer annular glue ring 332 is positioned concentrically underneath an outer portion of the rear annular diaphragm 330. A rear annular outer aluminum ring 334 is coupled to the rear outer annular glue ring 332 and lies in a plane orthogonal to the central axis 100.

An inner portion of the rear annular diaphragm 330 may be mounted axially between the rear base portion 214 and a rear inner annular glue ring 336. In other words, the rear inner annular glue ring 336 is positioned directly below the inner portion of the rear annular diaphragm 330. A rear inner aluminum ring 340 is concentrically attached to a bottom side of the rear inner annular glue ring 336. A rear inner annular rubber ring 338 may be concentrically mounted directly below the rear inner aluminum ring 340 at the inner portion of the front annular diaphragm 230.

A rear voice coil 342 is attached to a moveable portion of the rear annular diaphragm 330. The rear voice coil 342 may be attached via glue or other suitable manner to the rear annular diaphragm 330. A rear top plate 358 is positioned below the rear annular outer aluminum ring 334. A rear magnet 356 is positioned directly below the rear top plate 358.

A rear back plate (or pole piece) 350 having an inner extended portion 352 and an exterior outer portion 354 lies in a plane orthogonal to the central axis 100 and is received by the annular mounting structure 224 of the rear phasing plug 212. As shown in FIG. 1, the inner extended portion 352 surrounds at least a portion of the annular mounting structure 224 and is positioned below the inner portion of the rear annular diaphragm 330. The rear magnet 356 is positioned above the exterior outer portion 354 of the back plate 350 and surrounds at least a portion of the inner extended portion 352. The rear top plate 358 is positioned between the rear magnet 356 and the rear annular outer aluminum ring 334. A heat sink 362 is positioned underneath the back plate 350 for dissipating heat away from the dual asymmetric compression driver 200.

FIG. 3 is a detailed cross-sectional view of the front annular diaphragm 230 of the front driver assembly 201 and the rear annular diaphragm 330 of the rear driver assembly 203 as positioned on the dual asymmetric compression driver 200 in accordance to one embodiment. In general, the front voice coil 242 and the rear voice coil 342 may have any configuration which, in response to electrodynamic excitation, respectively causes axial oscillation (in the direction of the central axis 100) or translation of the front annular diaphragm 230 and the rear annular diaphragm 330 in a known manner.

The inner extended portion 252 of the front back plate 250, the front magnet 256, and the front top plate 258 define a front axial gap 276 to allow a portion of the front annular diaphragm 230 and the front voice coil 242 to translate axially within the front axial gap 276 in response to the electrodynamic excitation. The front axial gap 276 defines a front compression chamber. In practice, the height of the front compression chamber (i.e., the size of the front axial gap 276 when the front annular diaphragm 230 is not being driven) may be quite small (e.g., approximately 0.5 mm or less) such that the volume of the front compression chamber is also small. While not shown, a plurality of front exits are formed on the output side of the front base portion 204 and are located at the central bore 206. The front exits may be circumferentially spaced relative to the central axis 100.

The front base portion 204 defines a plurality of front (or first) acoustical paths that run from the front compression chamber, through the thickness of the front base portion 204 via entrances and associated channels (not shown), and to the respective front exits. In operation, actuation of the front annular diaphragm 230 by the oscillating front voice coil 242 (that is energized by the audio signal input) generates high sound-pressure acoustical signals within the front compression chamber, and the acoustical signals travel as sound waves through the front base portion 204 along the front acoustical paths in a known manner.

In general, the inner extended portion 352 of the rear back plate 350, the rear magnet 356, and the rear top plate 358 define a rear axial gap 376 to allow a portion of the rear annular diaphragm 330 and the rear voice coil 342 to translate axially within the rear axial gap 376 in response to the electrodynamic excitation. The rear axial gap 376 defines a rear compression chamber and an inner copper ring 378 may be positioned on an outer ledge of the inner extended portion 352 of the back plate 350.

Figure 4:
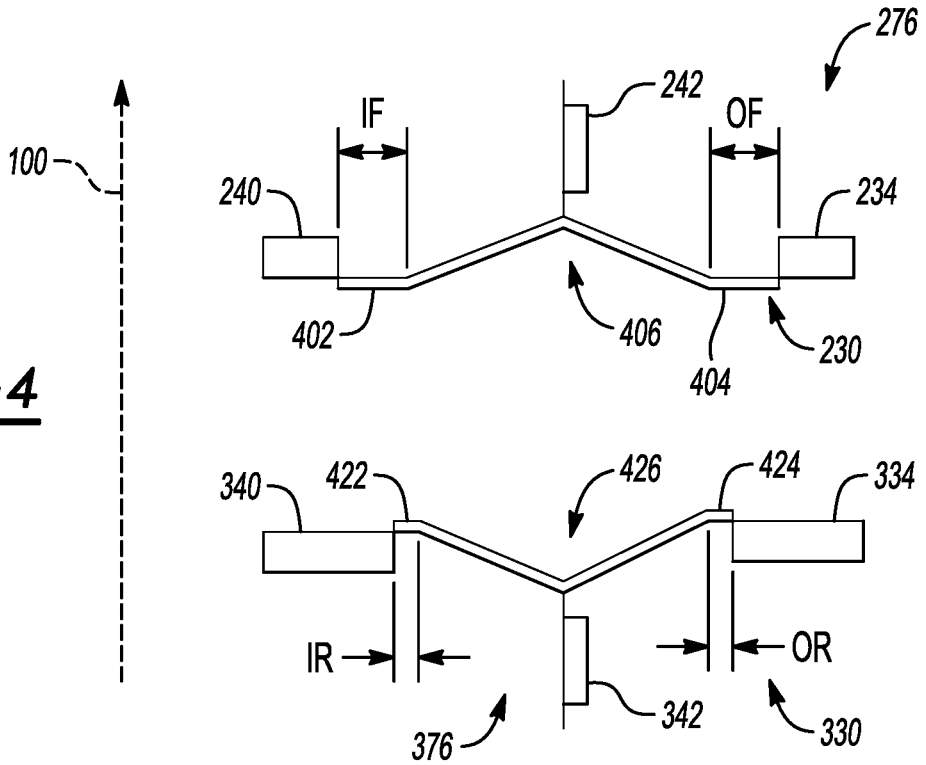
FIG. 4 depicts a cross-sectional view of the front annular diaphragm and the rear annular diaphragm having different clamping sizes in accordance to one embodiment.

FIG. 4 depicts a cross-sectional view of one side of the front annular diaphragm 230 and one side of the rear annular diaphragm 330 having different clamping sizes in accordance to one embodiment. The illustrated sides of the front annular diaphragm 230 and the rear annular diaphragm 330 may correspond to the front annular diaphragm 230 and the rear annular diaphragm 330 that is shown to the right of the central axis 100 as shown in FIG. 1. The front annular diaphragm 230 includes an inner radial planar section 402 (or first planar section) and an outer radial planar section 404 (or second planar section). As shown, the inner radial planar section 402 is positioned closer to the central axis 100 than the outer radial planar section 404.

The front annular diaphragm 230 includes a generally V-shaped section 406 (or non-planar section) that is positioned between the inner radial planar section 402 and the outer radial planar section 404. It is recognized that the V-shaped section 406 of the front annular diaphragm 230 may not necessarily be V-shaped and that the section 406 may take on any number of completely non-planar shapes based on a particular implementation. As shown, the front voice coil 242 is attached to the front annular diaphragm 230. An overall length (or clamping dimension) for the inner radial planar section 402 is illustrated as IF and an overall length (or clamping dimension) for the outer radial planar section 404 is illustrated as OF.

Similarly, the rear annular diaphragm 330 includes an inner radial planar section (or first planar section) 422 and an outer radial planar section 424 (or second planar section). As shown, the inner radial planar section 422 is positioned closer to the central axis 100 than the outer radial planar section 424. The rear annular diaphragm 330 includes a generally V-shaped section (or non-planar section) 426 that is positioned between the inner radial planar section 422 and the outer radial planar section 424. It is recognized that the V-shaped section 426 of the rear annular diaphragm 330 may not necessarily be V-shaped and that the section 426 may take on any number of completely non-planar shapes based on a particular implementation. For example, the front annular diaphragm 230 and the rear annular diaphragm 330 does not need to be a strictly V-shaped section 406 and 426 with the inner radial planar sections 402 or 422 and the outer radial planar sections 404 and 424. Instead, a half-roll suspension may be used, etc. An overall length (or clamping dimension or clamping distance) for the inner radial planar section 422 is illustrated as "IR" and an overall length (or clamping dimension or clamping distance) for the outer radial planar section 424 is illustrated as "OR".

In general, the clamping dimension for the inner radial planar section 402 and the outer radial planar section 404 of the front annular diaphragm 230 corresponds to the distance of the inner and outer radial and planar vibrating portions of the front annular diaphragm 230. Similarly, the clamping dimension for the inner radial planar section 422 and the outer radial planar section 424 of the rear annular diaphragm 330 correspond to the distance of the inner and outer radial and planar vibrating portions of the rear annular diaphragm 330. Such clamping dimensions characterize properties of the frequency response along with the mechanical stiffness on the displacement of the front annular diaphragm 230 and the rear annular diaphragm 330. The front annular diaphragm 230 may be a midrange diaphragm where by the front driver assembly 201 provides an audio output in the mid-range frequency. For example, the clamping dimensions for each of IF and OF for the front annular diaphragm 230 may be larger than the clamping dimensions for each of IR and OR, respectively, for the rear annular diaphragm 330. The rear annular diaphragm 330 may be a high frequency diaphragm where by the rear driver assembly 203 provides an audio output in the high frequency range.

It is recognized that the clamping dimension for each of the inner radial planar section 402 (e.g., IF) and the outer radial planar section 404 (e.g., OF) may or may not be equal to one another. Likewise, it is recognized that the clamping dimension for each of the inner radial planar section 422 (e.g., IF) and the outer radial planar section 424 (e.g., OF) may or may not be equal to one another. Typically, the clamping dimensions for each OF and OR are equal to, or smaller than the clamping dimensions of IF and IR, respectively. The inner clamping dimensions (e.g., IF and IR) may be characterized by higher stiffness if both of such clamping dimensions are equal to one another. Each of the clamping dimensions may influence high frequency resonances (e.g., breakups) and in particular, optimal design configurations may result in different clamping dimensions.

While not shown in FIG. 4, it is contemplated that the front annular diaphragm 230 may be arranged to include the inner radial planar section 422 (e.g., IR) and the outer radial planar section 424 (e.g., OR) and the corresponding clamping dimensions noted for the inner radial planar section 422 and the outer radial planar section 424 that is currently shown in connection with the rear annular diaphragm 230 in FIG. 4. In this case, the rear annular diaphragm 330 may be arranged to include the inner radial planar section 402 (e.g., IF) and the outer radial planar section 404 (e.g., OF). In this example, the front assembly driver 201 may then be considered a high frequency driver and the rear assembly driver 203 may then be considered a mid-frequency driver. Again, with the example, the clamping dimension for each of the inner radial planar section 402 (e.g., IF) and the outer radial planar section 404 (e.g., OF) may or may not be equal to one another. Likewise, it is recognized that the clamping dimension for each of the inner radial planar section 422 (e.g., IF) and the outer radial planar section 424 (e.g., OF) may or may not be equal to one another. Typically, the clamping dimensions for each OF and OR is equal to, or smaller than the clamping dimensions of IF and IR, respectively. The clamping dimensions for each of IF and OF for the rear annular diaphragm 330 may be larger than the clamping dimensions for IR and OR, respectively, for the front annular diaphragm 330.

Another factor that may determine the mechanical properties for each of the front annular diaphragm 230 and the rear annular diaphragm 330 is the thickness of material for each diaphragm 230, 330. In general, the thickness of a polymer film for the rear annular diaphragm 330 may be equal to or greater than the thickness of a polymer film for the front annular diaphragm 230 to provide higher mechanical stiffness and correspondingly a higher fundamental resonance to extend the high frequency range of the rear annular diaphragm 330.

Table 1 as illustrated below shows the results of various simulations of the resonance frequency and a "second resonance" frequency as a function of thickness for the diaphragms 230, 330 (e.g., 75 microns and 100 microns) and of the clamping dimension that characterizes the inner radial planar section and the outer radial planar section for any one diaphragm 230, 330. The simulations provided below illustrate two thicknesses (e.g., 75 and 100 microns) and different clamp dimensions (e.g., see clamp size below in Table 1). Accordingly, particular geometries and thicknesses may be selected for the front annular diaphragm 230 and the rear annular diaphragm 330.

TABLE 1

| Clamp size, | Fundamental resonance, Hz | | Second resonance, Hz | |
|---|---|---|---|---|
| inch | 75 microns | 100 microns | 75 microns | 100 microns |
| 0.030" | 3503 | 4380 | 13645 | 17820 |
| 0.050" | 2507 | 3100 | 11390 | 14780 |
| 0.070" | 1667 | 2104 | 9505 | 12095 |
| 0.090" | 1294 | 1640 | 8718 | 11154 |
| 0.110" | 880 | 1140 | 6790 | 8586 |

Each of the inner and outer clamping dimensions (e.g., IF and OF or IR and OR) for the front annular diaphragm 230 (or the rear annular diaphragm 330) were kept equal. The clamping dimensions were 0.030", 0.050", 0.070", 0.090", and 0.110". The "second resonance" frequency is indicative of the onset of breakup modes and correspondingly, increased energy of the diaphragm 230 or 330 vibration. Such a condition was clearly observable in the simulation that overall axial acceleration of the diaphragm 230 or 330 excited by a constant force that is applied to the diaphragm 230 or 330 at the position of the voice coil 242 or 342. In general, breakup modes correspond to multiple high-frequency mechanical resonances of the diaphragm 230 or 330. For example, separate parts of the diaphragm 230 or 330 oscillate with different amplitudes and phases. Thus, the diaphragm 230 or 330 does not vibrate as a single body. The breakups are associated with increased overall displacement, velocity, and acceleration of vibration that increases the sound pressure level. It is especially recognized that the high-frequency diaphragm (or the rear annular diaphragm 330) has a strong peak of the response at 18 kHz to increase high frequency output. Another observation is that the frequency responses are rather smooth because of the high internal damping of the polymer film of the diaphragms 230 or 330.

Figure 5:
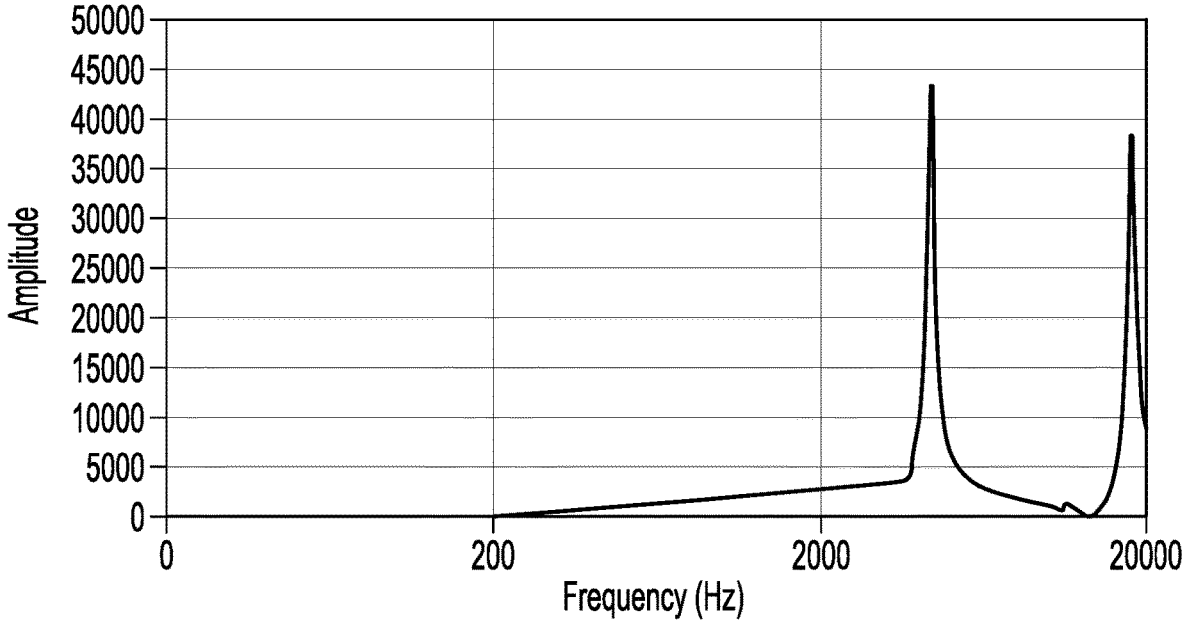
FIG. 5 depicts an example of average axial acceleration versus frequency for a diaphragm with a particular clamping dimension 0.030" and thickness of the diaphragm material 0.004" (100 microns)

FIG. 5 depicts an example of average axial acceleration for the rear annular diaphragm 330 with a particular clamping dimension 0.030" and thickness of the diaphragm material 0.004" (100 microns). As shown, the diaphragm 330 is driven by a source of force of having a constant amplitude of one Newton over the frequency range of 200 Hz-20 kHz.

Figure 6:
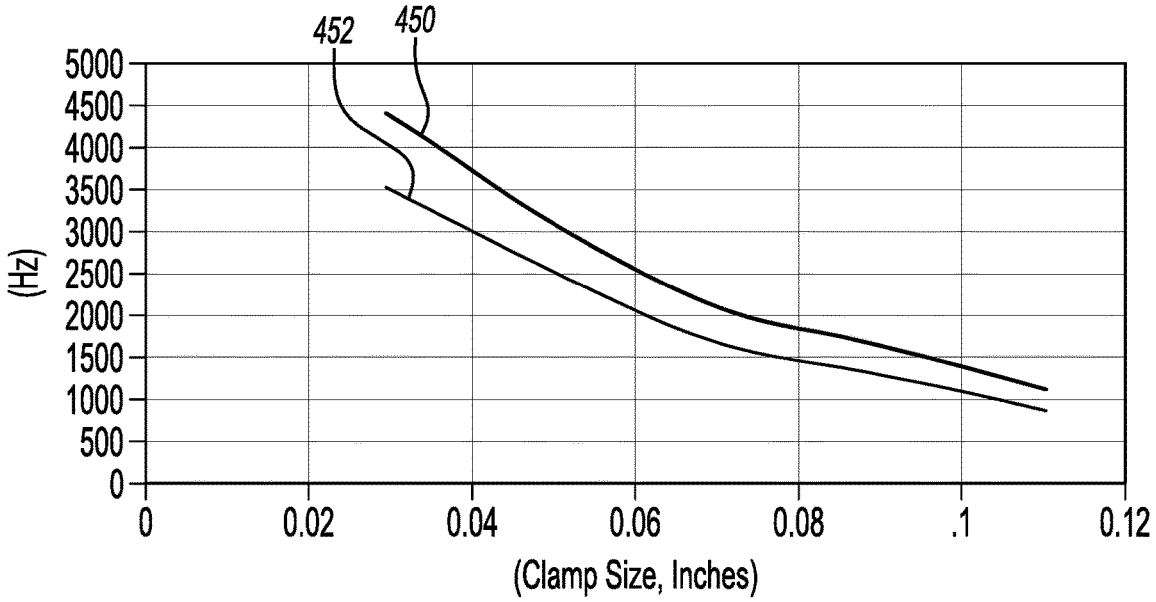
FIG. 6 depicts a frequency dependence of the fundamental resonance for the front diaphragm in accordance to one embodiment.

FIG. 6 depicts a fundamental resonance for the diaphragm 230 or 330 based on the clamp dimension and the thickness of front annular diaphragm 230 or the rear annular diaphragm 330 in accordance to one embodiment. Plot 450 generally corresponds to the front annular diaphragm 230 or the rear annular diaphragm 330 having a thickness of 100 microns. Plot 452 generally corresponds to the front annular diaphragm 230 or the rear annular diaphragm 330 having a thickness of 75 microns.

Figure 7:
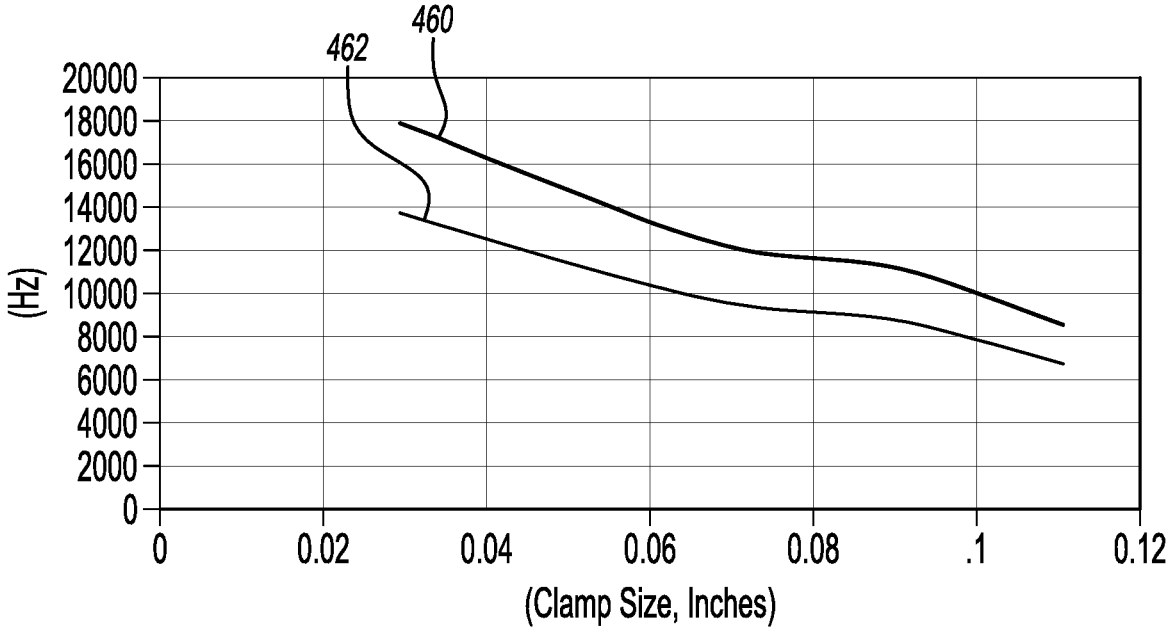
FIG. 7 depicts a frequency dependence of the fundamental resonance for the rear diaphragm in accordance to one embodiment.

FIG. 7 depicts a second resonance for the diaphragm based on the clamp dimension and the thickness of the front annular diaphragm 230 or the rear annular diaphragm 330 in accordance to one embodiment. Plot 460 generally corresponds to the front annular diaphragm 230 or the rear annular diaphragm 330 having a thickness of 100 microns. Plot 462 generally corresponds to the front annular diaphragm 230 or the rear annular diaphragm 330 having a thickness of 75 microns.

In general, the data as illustrated in Table 1 and in FIGS. 6-7 correspond to diaphragms 230 (or 330) that are placed in a vacuum and that data is provided to illustrate the manner in which the clamping dimensions and material's thicknesses (of the diaphragms 230 or 330) change the resonances' frequencies. In general, for a compression driver, the frequencies of the diaphragm's 230 or 330 resonances may be influenced by the mass of the voice coil 242 or 342, by a stiffness of air in a chamber behind the diaphragm 230 or 330 and by acoustical loading of the front of the diaphragm 230 or 330 that includes a compression chamber, internal waveguide that connects the compression chamber with an exit of the driver and by an external acoustical load. In one example, the front annular diaphragm 230 may have a thickness of 0.003" (75 microns) and a clamping dimension of 0.110". The rear annular diaphragm 330 may have a 0.004" (100 microns) and a clamping dimension of 0.030".

In the case of the dual asymmetric compression driver 200 as set forth herein, the mechanical parameters of the diaphragms 230 and 330 are different. For example, the rear driver assembly 203 associated with the rear annular diaphragm 330 (e.g., high-frequency driver) includes a lower moving mass and a higher stiffness than that of the front annular diaphragm. In addition, the volumes of the front and rear compression chambers are different as well. For example, the volume of the rear compression chamber may be smaller than that of the front compression chamber. The compression chamber's volume of the rear (HF) driver (or rear driver assembly 203) may be smaller for two reasons. For example, an area of the rear annular diaphragm 330 may be smaller, and the height of the compression chamber is smaller because the amplitude of the displacement of rear annular diaphragm 330 is much smaller than the displacement of the front annular diaphragm 330. Therefore, the acoustical compliance of the rear compression chamber may be smaller too. This aspect may be a positive factor because larger acoustical compliance acts as a low-pass filter with a lower cut-off frequency. Each diaphragm 230 and 330 is loaded by a corresponding compression chamber (i.e., the front compression chamber and the rear compression chamber, respectively) and the front phasing plug 202 and the rear phasing plug 212, respectively, and by a parallel connection of two acoustical impedances. One of such acoustical impedances is an acoustical impedance of shared acoustical elements such as phasing plugs followed by a horn or a waveguide and by an output acoustical impedance of an adjacent driver. For normal operation, both driver assemblies 201 and 203 may operate through crossovers such as a high-pass (or band pass) filter for the midrange section (e.g., the front driver assembly 201) and a high-pass filter for the high frequency section (e.g., the rear driver assembly 203). The crossovers may be active or passive, or can be a combination of both.

Figure 8:
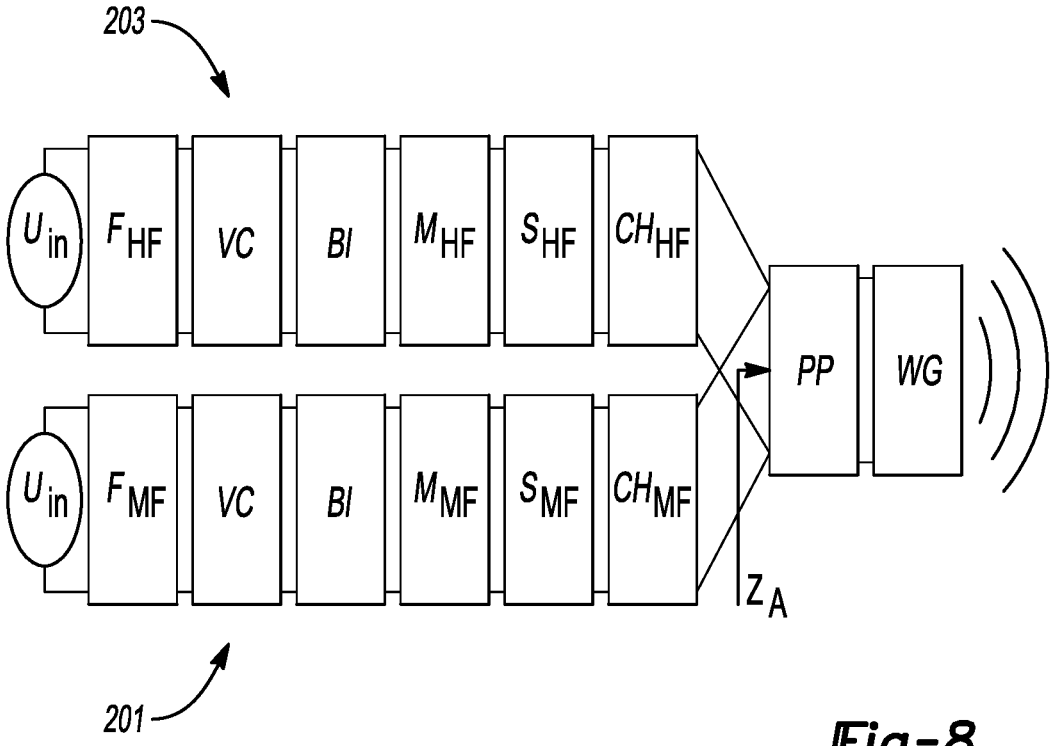
FIG. 8 depicts a matrix model of the dual asymmetric compression driver.

FIG. 8 depicts a matrix model of the dual asymmetric compression driver 200 in accordance to one embodiment. The following variables as illustrated in FIG. 8 are set forth and defined below for reference:

$U_{in}$—corresponds to an input voltage from amplifier, $F_{HF}$ and $F_{MF}$—correspond to passive filters for the high-frequency and the midrange drivers (e.g., the rear driver assembly 203 and the front driver assembly 201, respectively), VC—voice coil, Bl—force factor, $M_{HF}$ and $M_{MF}$—mechanical parts (i.e., the moving assembly) of the high-frequency and the midrange drivers (e.g., the rear driver assembly 203 and the front driver assembly 201, respectively), $S_{HF}$ and $S_{MF}$—effective areas of the high-frequency and the midrange drivers, $CH_{HF}$ and $CH_{MF}$—compression chambers, $Z_A$— is an input acoustical impedance of the acoustical part presenting mutual acoustical load for both drivers (e.g., the rear driver assembly 203 and the front driver assembly 201, respectively), PP—correspond to common acoustical elements for the front phasing plug 202 and the rear phasing plug 212, and WG—corresponds to an internal waveguide that is acoustically connected to an external load such as a waveguide or horn. In general, both single drivers (e.g., the rear driver assembly 203 and the front driver assembly 201) in the model shown on FIG. 8 are loaded by mutual acoustical elements PP and WG. In general, the front and the rear voice coils and Bl-products may be different. For example, currently a thin copper sleeve in the front voice coil gap is used to decrease inductance of the voice coil (and to increase HF output). But such a condition may decrease the Bl product by a small amount.

Each of the elements in the model as illustrated in FIG. 8 is presented by a square transfer A-matrix. Application of this type of matrix is often used to model input impedance and transfer function of electro-mechanical-acoustical systems that can be presented as a combination of cascaded electrical, mechanical, and acoustical elements. An example of the square transfer A—matrix in connection with other electro-mechanical acoustical systems can be found in "Transmission Matrices in Electroacoustics", M. Lampton, *Acoustica*, vol. 39, No. 4, 1978, pp. 239-251 and also in "Simulation of Horn Driver Response by Combination of Matrix Analysis and FEA", Alex Voishvillo, 129th AES Convention, 2010, San Francisco, preprint 8214.

Figure 9:
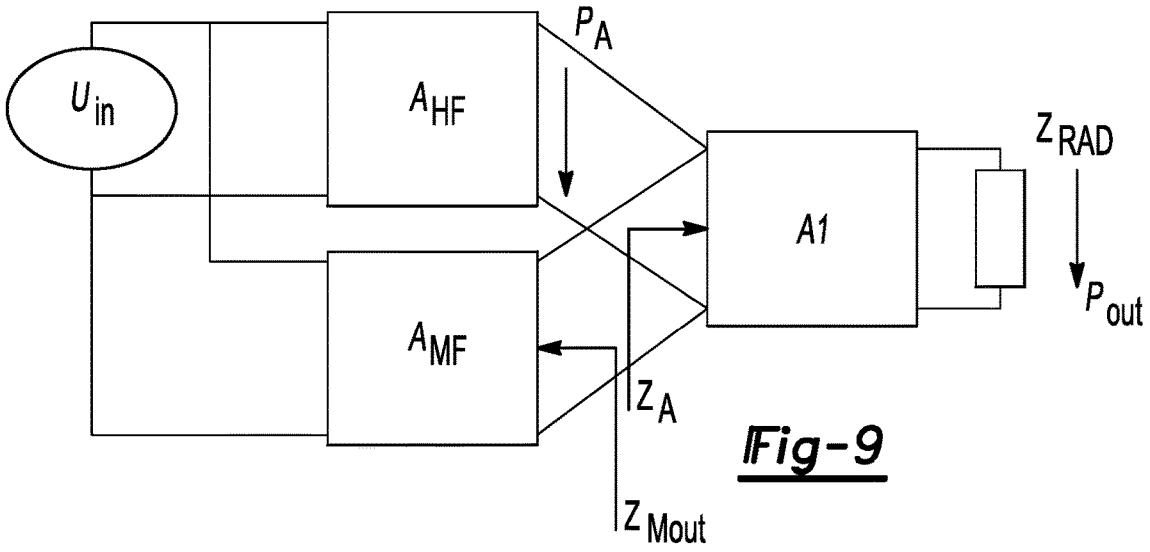
FIG. 9 depicts a simplified matrix model of the dual asymmetric compression driver in accordance to one embodiment.

FIG. 9 depicts a simplified matrix model of the dual asymmetric compression driver 200 in accordance to one embodiment. The following variables as illustrated in FIG. 9 are set forth below and are defined for reference.

$A_{HF}$ and $A_{MF}$ are matrices derived from the matrix multiplication of the corresponding matrices as shown on FIG. 8, A1 is a matrix derived from the matrix multiplication of matrices PP and WG, and $Z_{RAD}$ is radiation impedance.

If only the resulting SPL frequency response produced by both drivers (e.g., the rear driver assembly 203 and the front driver assembly 201) is of interest, then the simplest method is to transform the $A_{HF}$ and $A_{MF}$ matrices into corresponding $Y_{HF}$ and $Y_{MF}$ matrices that are used in analysis of two-port circuits connected in parallel at the input and output. In general, the input corresponds to a location where electrical inputs of the drivers are connected in parallel. The output corresponds to a location where acoustical signals from both compression chambers merge into mutual centrally-orientated channels. At that point, it is possible to sum the matrices $Y_{HF}$ and $Y_{MF}$ to obtain matrix $Y_\Sigma$ (or $Y_\Sigma = Y_{HF} \pm Y_{MF}$), and then turn the matrix $Y_\Sigma$ into a new transfer matrix $A_\Sigma$. Such a matrix can be cascaded with an acoustical A1 matrix (by multiplication) and then the overall complex output sound pressure can be expressed as:

$$P_{out} = \frac{U_{in}}{A_{\Sigma 11} A1_{11} + A_{\Sigma 12} A1_{21} + (A_{\Sigma 11} A1_{12} + A_{\Sigma 12} A1_{22})/Z_{RAD}} \tag{1}$$

With this approach, a mutual influence of the drivers (e.g., the rear driver assembly 203 and the front driver assembly 201) is taken into account. Acoustical matrix parameters can then be modeled by Finite Element Analysis (FEA) or via transmission line approach as set forth in "Horn Modeling with Conical and Cylindrical Transmission Line Elements", Dan Mapes-Riordan, *J. Audio Eng. Soc.*, vol. 41, No. 6, 1993 June, pp. 471-484.

If an individual SPL response of one of the drivers (e.g., the rear driver assembly 203 or the front driver assembly 201) has to be modeled, then the approach may be different. It is based on the assumption that the other driver is short-circuited at the electrical input because it is connected to the source of voltage with zero output impedance. For example, if it is desirable to model the sound pressure response of the high-frequency driver (e.g., the rear driver assembly 203), it is possible to consider that the high frequency driver is loaded by the parallel connection of $Z_A$ and the output acoustical impedance of the midrange driver $Z_{Mout}$ (or the front driver assembly 201). Since the input of the matrix being presented to the midrange driver is connected to the source of voltage with a zero output impedance, the output impedance of the midrange driver may be modeled as:

$$Z_{Mout} = \frac{inv[A_{MF12}]}{inv[A_{MF22}]} \tag{2}$$

where $inv[A_{MF12}]$ and $inv[A_{MF22}]$ are corresponding matrix elements of the inverted matrix $A_{MF}$.

Denoting the parallel connection of the acoustical impedances $Z_{Mout}$ and $Z_A$ as $Z_{MA}$, the sound pressure at an exit of the compression chamber of the high-frequency driver $P_A$ (e.g., the rear driver assembly 203) can be calculated as:

$$P_A = \frac{U_{in}}{A_{HF11} + A_{HF12}/Z_{MA}} \tag{3}$$

The sound pressure $P_A$ is used as a source for the acoustical matrix A1:

$$P_{out} = \frac{P_A}{A1_{11} + A1_{12}/Z_{RAD}} \tag{4}$$

The response of the midrange driver (or the front driver assembly 201) can be calculated correspondingly assuming the high-frequency driver (or the rear driver assembly 203) is short-circuited.

Initial information for effective areas of the diaphragms 230 or 330 can be obtained from a Klippel scanner or by using the method as set forth in, "Identification of Compression Driver Parameters Based on a Concept of the Diaphragm's Frequency-Dependent Area", A. Voishvillo as presented at 137$^{th}$ AES Convention, Los Angeles, Oct. 11, 2014, preprint 9165.

The initial information for the effective areas of the diaphragms 230 or 330 along with other electromechanical and acoustical parameters of the midrange and high-frequency drivers (or front driver assembly 201 and the rear driver assembly 203) was used in modeling and the development of the dual asymmetric driver 200 based on, for example, 2-inch diameter voice coils and a 1-inch exit.

In the development process, the modeling was carried out first for the simple case of lumped parameters and where there was no mutual influence of midrange and high-frequency drivers 201, 203 on each other. Initial simplification also included plane wave tube loading. At the next stage, the mutual influence of the drivers 201, 203 was taken into account. Next, the individual responses of both drivers 201 and 203 with frequency-dependent areas of the diaphragms 230, 330 were taken into account, and then the mutual influence of drivers 201, 203 with frequency-dependent areas of the diaphragms 230, 330 areas were taken into account as well. The next stage of the development process included optimization of SPL frequency responses and the alignment of time delays and phase responses between mid-frequency and high-frequency channels of the drivers 201, 203.

Figure 10:
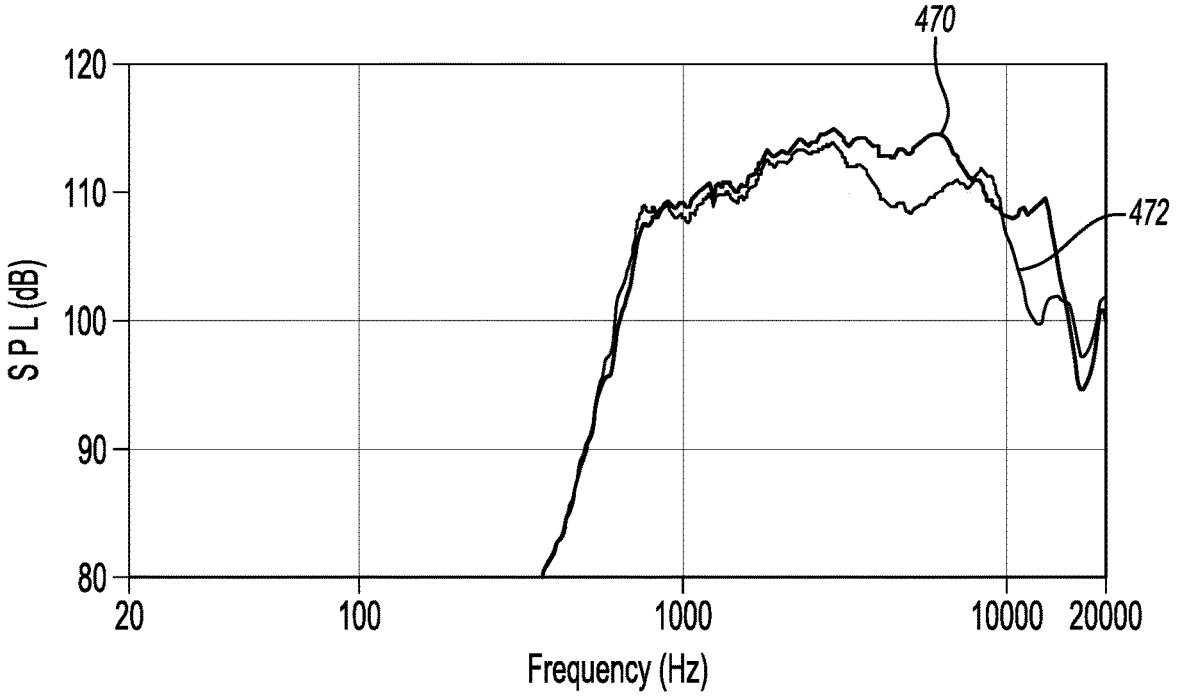
FIG. 10 depicts an SPL frequency response for a mid-range driver with and without the influence of a high-frequency driver.

FIG. 10 depicts an SPL response for a mid-range driver (e.g., the front driver assembly 201) with and without the influence of a high-frequency driver (e.g., the rear driver assembly 203). For example, FIG. 10 illustrates the SPL frequency responses of the midrange driver 201 without the influence of the high frequency driver 203 (see plot 470), and then with the influence of high-frequency driver (see plot 472). Specifically, the mid-range driver 201 is used on a Holland-Newell horn.

Figure 11:
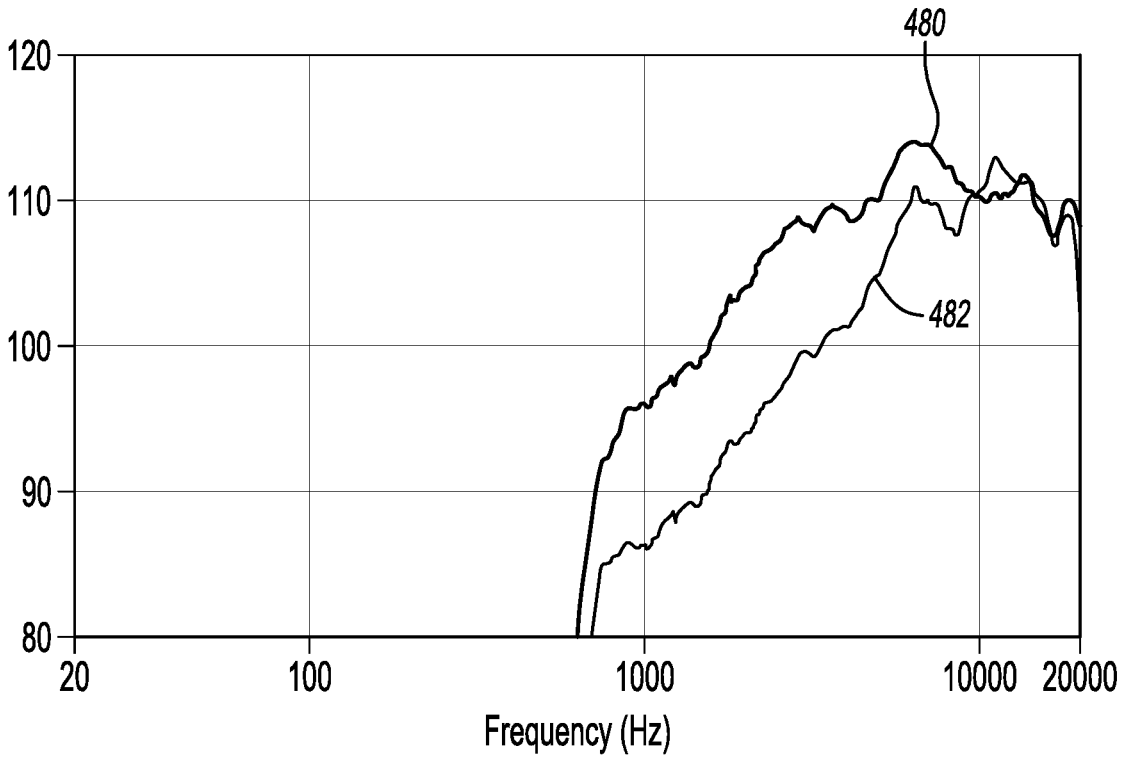
FIG. 11 depicts an SPL response for a high frequency driver with and without the influence of a mid-range driver.

FIG. 11 depicts an SPL response for the high frequency driver 203 with and without the influence of a mid-range driver 201. For example, FIG. 11 illustrates the SPL frequency responses of the high-frequency driver 203 without the influence of the midrange driver 201 (see plot 480) and with the influence of the mid-range driver 201 (see plot 482). Similarly to FIG. 10, the mid-range driver 201 is used on a Holland-Newell horn.

Figure 12:
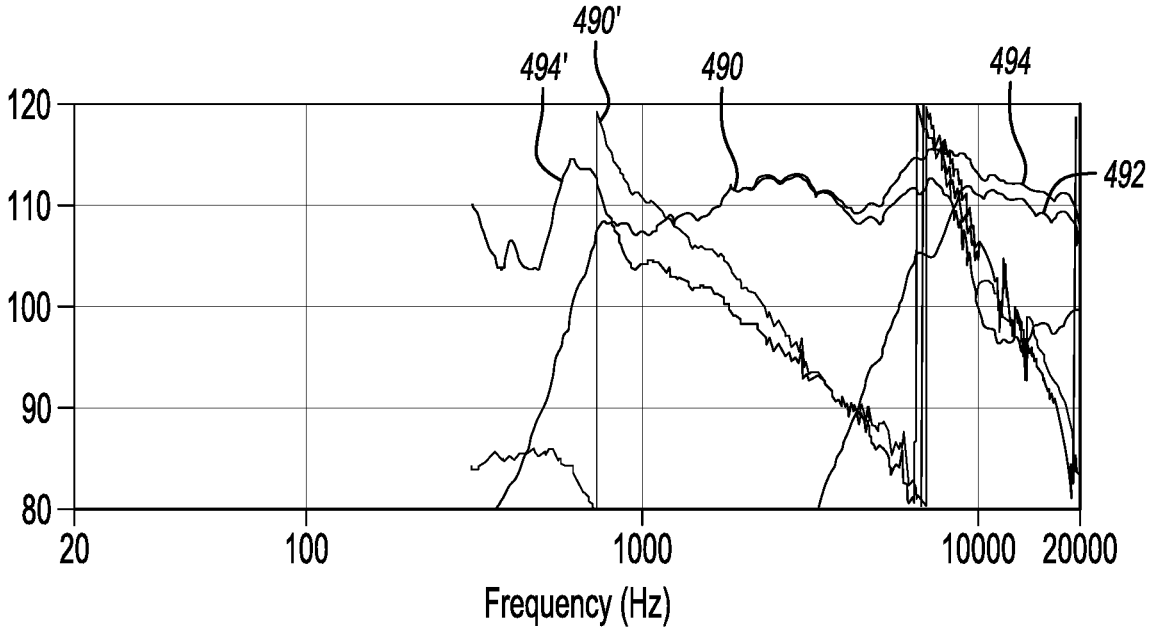
FIG. 12 depicts an individual SPL frequency and phase response for mid-range and high-frequency drivers with crossovers and overall response.

FIG. 12 depicts an individual SPL frequency and phase response for the mid-range driver 201 and the high-frequency driver 203 with crossovers and overall response. Plot 490 illustrates the SPL response of the mid-range driver 201 with an all-pass filter of the second order. Plot 492 illustrates the SPL response of the high-frequency driver 203 with a high-pass filter of the third order. Plot 494 illustrates the overall SPL response (acoustical summation of both channels). The "diagonal" curves 490' and 492' as shown in FIG. 12 illustrate SPL phase responses for the high-frequency driver 203 and the mid-range driver 201. In the frequency range of overlapping of MF and HF responses, the phases of MF and HF phase responses practically coincide which provides a maximum SPL output.

The mid-range driver 201 and the high-frequency driver 203 are connected via crossovers in that the high-frequency driver 203 includes a high-pass filter of the third order, and the mid-range driver 201 includes an all-pass circuit of the second order tuned that may be tuned to, for example, 10 kHz. The midrange driver 201 may not include a low-pass filter to maximize the high frequency output, which therefore adds a corresponding lower-SPL output at a high frequency that aids in boosting the overall high-frequency output of the driver 200. FIGS. 10-12 illustrate that the phase responses of the mid frequency and high drivers 201, 203 are nearly coincident in the frequency range of their mutual radiation which is indicative of not only phase alignment, but of the group delay alignment as well.

The mutual internal acoustical interaction between the mid-frequency driver 201 and high-frequency driver 203 change their corresponding SPL responses (i.e., when compared to the individual radiation of each one without the influence of the counterpart) and attenuates the SPL at certain frequencies, but nevertheless, the overall level of the SPL frequency response of this dual asymmetric compression driver 200 maybe superior to compression drivers based on traditional design.

Figure 13:
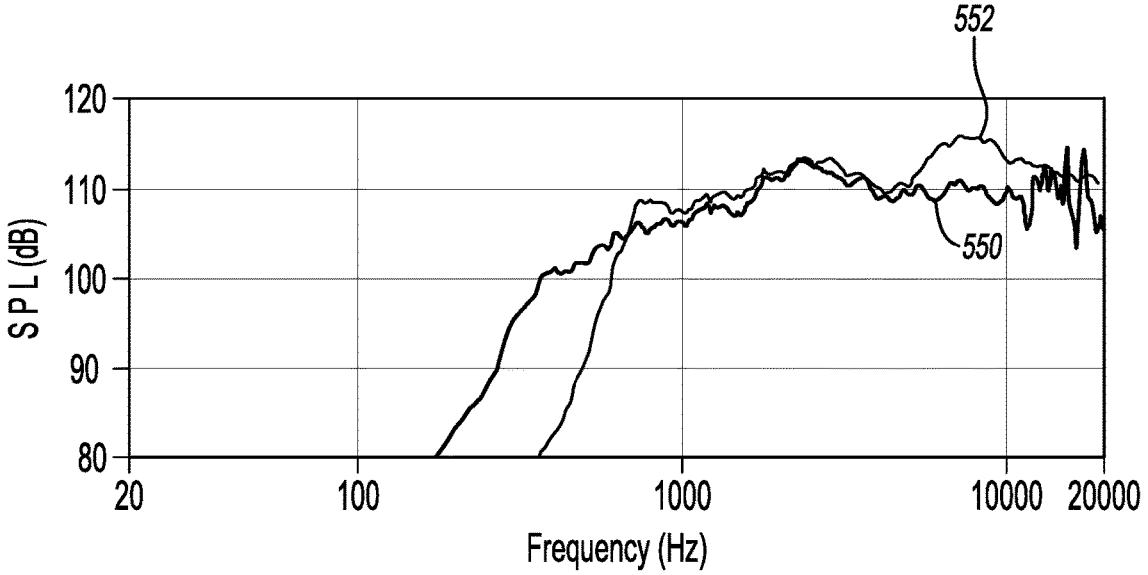
FIG. 13 depicts a SPL frequency response for a conventional compression driver equipped with a titanium dome diaphragm in comparison to the SPL frequency response of the dual asymmetric compression driver.

FIG. 13 depicts a sound pressure frequency level and distortion for a conventional compression driver equipped with a titanium dome diaphragm (see plot 550) in comparison to the sound pressure level and distortion for the driver 200 (see plot 552) as set forth herein. For example, FIG. 13 illustrates the measured plane wave tube frequency response and the harmonic distortion including ½ subharmonic for a conventional compression driver that is based on a titanium diaphragm and on a 3-inch voice coil. A high level of harmonic distortion and especially of the ½—order subharmonic is observed when an input power of 10 Watts is provided. The responses were measure on 1.5 inch plane wave tube.

Figure 14:
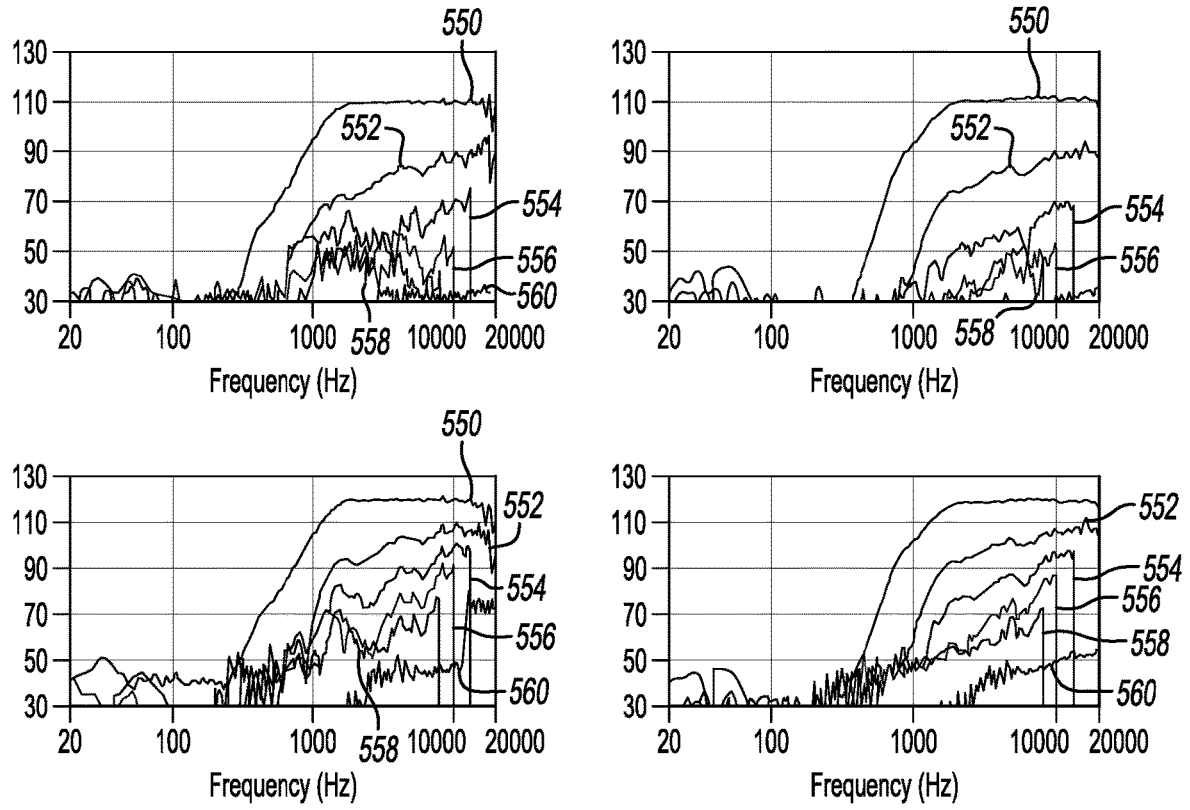
FIG. 14 depicts a harmonic distortion comparison between a conventional compression driver equipped with a 3" titanium dome that is loaded by a Holland-Newell axisymmetric horn (see plots on the left side) and the dual asymmetric compression driver (see plots on the right hand side).

FIG. 14 depicts a harmonic distortion comparison between a conventional compression driver equipped with a 3" titanium dome that is loaded by a Holland-Newell axisymmetric horn (see plots on the left side) and the dual asymmetric compression driver 200 (see plots on the right hand side) as set forth herein. Plot 550 illustrates an—SPL frequency response (fundamental harmonic), plot 552 illustrates a second harmonic, plot 554 illustrates a third harmonic, plot 556 illustrates a fourth harmonic, plot 558 illustrates a fifth harmonic, plot 660 illustrates a subharmonic (half-harmonic). Measured at 110 dB SPL and 120 dB SPL at 1 meter from the horn. The conventional driver has higher harmonic distortion at high frequencies, especially at 120 dB SPL. Second harmonic has a very high level at 120 dB there is a strong onset of sub-harmonic. At lower frequencies, in the vicinity of the high-pass cut-off frequency (1.5 kHz) the onset of 3$^{rd}$ and 5$^{th}$ harmonics is observed that is indicative of the mechanical limiting of the titanium suspension of the conventional diaphragm.

In general, the dual asymmetric compression driver 200 as disclosed herein, provides, but not limited to, two diaphragms that are mechanically "tuned" to different frequency ranges. Such a two-way configuration makes it possible to optimize performance for each diaphragm for a corresponding frequency range. Similar shape annular flexural diaphragms, similar voice coils and similar motors may be utilized however; the clamping dimensions of the diaphragms may be different from one another thereby providing for two different moving masses and suspension compliances. Correspondingly, the moving assemblies have resonance frequencies that are different by, for example, approximately two octaves. Smaller moving mass and suspension compliance of the high-frequency diaphragm assembly (or the rear driver assembly 203) may result in a higher fundamental frequency and a second resonance frequency that provide an extension of the frequency range.

The high-frequency diaphragm (e.g., the rear annular diaphragm 330) may utilize less maximum displacement than the mid-frequency diaphragm (e.g., the front annular diaphragm 230), therefore the height of the high-frequency compression chamber (i.e., the rear compression chamber) is approximately half as high compared to the midrange compression chamber (i.e., the front compression chamber). This aspect provides a smaller volume of the high-frequency compression chamber and lower acoustical compliance of the high-frequency chamber that also aids to extend the high-frequency range.

The mutual internal acoustical interaction between the high-frequency and the mid-frequency drivers changes their corresponding SPL responses (i.e., when compared to the individual radiation of each one without influence of the counterpart) and attenuates the SPL at certain frequencies, but nevertheless, the overall SPL frequency response of the dual asymmetric compression driver may be more advantageous than conventional compression drivers.

While embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A dual asymmetric compression driver comprising:

a first driver assembly being positioned about a central axis and including a first annular diaphragm having a first planar section extending at a first clamping distance; and a second driver assembly being positioned about the central axis and including a second annular diaphragm having a second planar section extending at a second clamping distance, the first clamping distance being different from the second clamping distance causing the first driver assembly to provide a first audio output in a first frequency range and the second driver assembly to provide a second audio output in a second frequency range, wherein the first frequency range is different than the second frequency range, and wherein the first annular diaphragm includes a first thickness and the second annular diaphragm includes a second thickness, the first thickness being different than the second thickness.

2. The dual asymmetric compression driver of claim 1 wherein the first clamping distance corresponds to a distance of the first planar section of the first annular diaphragm that vibrates while providing the first audio output in the first frequency range.

3. The dual asymmetric compression driver of claim 2 wherein the second clamping distance corresponds to a distance of the second planar section of the second annular diaphragm that vibrates while providing the second audio output in the second frequency range.

4. The dual asymmetric compression driver of claim 1 wherein the first annular diaphragm includes a third planar section extending at a third clamping distance that is different than the first clamping distance.

5. The dual asymmetric compression driver of claim 4 wherein the first planar section is positioned closer to the central axis than the third planar section.

6. The dual asymmetric compression driver of claim 4 wherein the first annular diaphragm further includes a non-planar section positioned between the first planar section and the third planar section.

7. The dual asymmetric compression driver of claim 4 wherein the second annular diaphragm includes a fourth planar section extending at a fourth clamping distance that is different than the second clamping distance.

8. The dual asymmetric compression driver of claim 7 wherein the first clamping distance and the third clamping distance of the first annular diaphragm are larger than the second clamping distance and the fourth clamping distance of the second annular diaphragm.

9. The dual asymmetric compression driver of claim 7 wherein the second planar section is positioned closer to the central axis than the fourth planar section.

10. The dual asymmetric compression driver of claim 7 wherein the second annular diaphragm includes a non-planar section positioned between the second planar section and the fourth planar section.

11. A dual asymmetric compression driver comprising:

a first driver assembly being aligned on a central axis and including a first annular diaphragm having a first planar section extending at a first clamping distance, the first driver assembly providing a first audio output in a first frequency range; and a second driver assembly being aligned on the central axis and including a second annular diaphragm having a second planar section extending at a second clamping distance, the second driver assembly providing a second audio output in a second frequency range, the first clamping distance being different from the second clamping distance, wherein the first frequency range is different than the second frequency range, wherein the first annular diaphragm is arranged at a first thickness, wherein the second annular diaphragm is arranged at a second thickness, and wherein the first thickness is different than the second thickness.

12. The dual asymmetric compression driver of claim 11 wherein the first clamping distance corresponds to a distance of the first planar section of the first annular diaphragm that vibrates while providing the first audio output in the first frequency range.

13. The dual asymmetric compression driver of claim 12 wherein the second clamping distance corresponds to a distance of the second planar section of the second annular diaphragm that vibrates while providing the second audio output in the second frequency range.

14. The dual asymmetric compression driver of claim 11 wherein the first annular diaphragm includes a third planar section extending at a third clamping distance that is different than the first clamping distance.

15. The dual asymmetric compression driver of claim 14 wherein the first planar section is positioned closer to the central axis than the third planar section.

16. The dual asymmetric compression driver of claim 14 wherein the second annular diaphragm includes a fourth planar section extending at a fourth clamping distance that is different than the second clamping distance.

17. The dual asymmetric compression driver of claim 16 wherein the first clamping distance and the third clamping distance of the first annular diaphragm are larger than the second clamping distance and the fourth clamping distance of the second annular diaphragm.

18. The dual asymmetric compression driver of claim 16 wherein the second planar section is positioned closer to the central axis than the fourth planar section.

19. A dual asymmetric compression driver comprising:

a front driver assembly being aligned on a central axis and including a front annular diaphragm having a front inner planar section extending at a front inner clamping distance and a front outer planar section extending at a front outer clamping distance to provide a front audio signal in a first frequency range; and a rear driver assembly being aligned on the central axis and including a rear annular diaphragm having a rear inner planar section extending at a rear inner clamping distance to provide a rear audio signal in a second frequency range and a rear outer planar section extending at a rear outer clamping distance, wherein front inner clamping distance and the front outer clamping distance is larger than the rear inner clamping distance and the rear outer clamping distance, respectively, where the first frequency range is different than the second frequency range, wherein the front annular diaphragm includes a first thickness, wherein the rear annular diaphragm includes a second thickness, and wherein the first thickness is different than the second thickness.

* * * * *